US012642371B1

(12) United States Patent
Rauschert

(10) Patent No.: US 12,642,371 B1
(45) Date of Patent: Jun. 2, 2026

(54) MOUNTING PANEL

(71) Applicant: Midwest Control Products Corp., Bushnell, IL (US)

(72) Inventor: Matthew K. Rauschert, Avon, IL (US)

(73) Assignee: Midwest Control Products Corp., Bushnell, IL (US)

( * ) Notice: Subject to any disclaimer, the term of this patent is extended or adjusted under 35 U.S.C. 154(b) by 0 days.

(21) Appl. No.: 19/064,799

(22) Filed: Feb. 27, 2025

Related U.S. Application Data

(60) Provisional application No. 63/567,106, filed on Mar. 19, 2024.

(51) Int. Cl.
*A47F 5/08* (2006.01)
*A47F 5/00* (2006.01)

(52) U.S. Cl.
CPC ..... *A47F 5/0846* (2013.01); *A47F 5/0815* (2013.01); *A47F 5/0093* (2013.01); *A47F 5/08* (2013.01); *A47F 5/0807* (2013.01); *A47F 5/083* (2013.01)

(58) Field of Classification Search
CPC ..... A47F 5/0848; A47F 5/0815; A47F 5/083; A47F 5/0807; A47F 5/08; A47F 5/0823; A47F 5/0838; A47F 5/0846; A47F 5/0853; A47F 5/0869; A47F 5/0876; A47F 5/0093; B25H 3/04
See application file for complete search history.

(56) References Cited

U.S. PATENT DOCUMENTS 24,361 A * 6/1859 Smith ..... F16B 12/58 5/300
1,303,090 A * 5/1919 McCray ..... B26B 23/00 30/337
3,045,961 A * 7/1962 Cygan ..... G09F 7/08 D25/123
3,562,988 A * 2/1971 Gregorie ..... E04B 2/12 52/590.3
4,573,513 A * 3/1986 Small ..... A47G 5/00 160/351
4,589,557 A * 5/1986 Bollmann ..... A61G 12/005 248/222.51
4,932,538 A * 6/1990 Gambello ..... A47F 5/0846 248/222.51
5,215,198 A * 6/1993 Sutton ..... A47F 7/146
5,253,770 A * 10/1993 Rosenthal ..... A47F 5/0025 211/88.01
5,269,619 A * 12/1993 Warkus ..... F16B 7/0473 403/255
5,345,716 A * 9/1994 Caplan ..... E04H 9/14 52/579
5,477,969 A * 12/1995 Beeskau ..... A47F 5/0815 248/225.11
5,779,412 A * 7/1998 Nagai ..... F16B 37/046 411/432
6,105,794 A * 8/2000 Bauer ..... A47B 96/063 211/208

(Continued)

*Primary Examiner* — Devin K Barnett
(74) *Attorney, Agent, or Firm* — Philip L. Bateman

(57) ABSTRACT

A mounting panel for accepting a variety of hooks and holders has a plurality of raised members on a base that are arranged in a grid of straight rows and columns. Each raised member has four inwardly sloping side walls to define a dovetail slot between each row and between each column.

3 Claims, 9 Drawing Sheets

(56) References Cited

U.S. PATENT DOCUMENTS

| | | | | |
|---|---|---|---|---|
| 6,409,030 | B1 * | 6/2002 | Schlemper | D05C 15/20 211/70.6 |
| 6,929,131 | B1 * | 8/2005 | Landi | A47F 5/0846 248/222.51 |
| 7,802,680 | B2 * | 9/2010 | Krebs | B25H 3/04 206/349 |
| 10,264,883 | B2 * | 4/2019 | Stefenack | A47B 96/02 |
| 11,786,983 | B2 * | 10/2023 | Wang | B27B 27/02 83/477.2 |
| 2006/0019232 | A1 * | 1/2006 | Fischer | G09B 25/04 434/407 |
| 2007/0241070 | A1 * | 10/2007 | Maheu | A47F 5/0815 211/87.01 |
| 2008/0115435 | A1 * | 5/2008 | Riviere | E04B 2/08 52/286 |
| 2008/0210651 | A1 * | 9/2008 | Chen | A47B 57/56 211/207 |
| 2009/0313919 | A1 * | 12/2009 | Chuang | G09F 7/08 52/202 |
| 2013/0334155 | A1 * | 12/2013 | Kasza | A47B 96/063 211/74 |
| 2015/0354612 | A1 * | 12/2015 | Koch | F16B 5/0052 403/376 |
| 2018/0073248 | A1 * | 3/2018 | Derleth | E04B 1/541 |
| 2021/0214942 | A1 * | 7/2021 | Lacas | E04C 1/395 |

* cited by examiner

MOUNTING PANEL

CROSS-REFERENCE TO RELATED APPLICATION

This application claims the benefit of U.S. Provisional Patent Application Ser. No. 63/567,106, Mar. 19, 2024.

FIELD OF THE INVENTION

This invention relates to the storage of tools and supplies.

BACKGROUND OF THE INVENTION

It is often desirable to store tools, parts, supplies, and other items so they are in plain sight. The items are sometimes stored on shelves or in cubicles that take up floor space. To conserve floor space, the items are sometimes stored on walls and other vertical surfaces. A variety of hooks and holders are often used to store items on vertical surfaces. Pegboards and slatwalls are commonly used as mounting panels to support the hooks and holders. However, pegboards and slatwalls have limitations. The hooks and holders compatible with them have limited weight capacity. The hooks and holders can also be dislodged accidentally.

Accordingly, there is a demand for an improved mounting panel for hooks and holders. More particularly, there is a demand for a mounting panel that has a large weight capacity and that supports its hooks and holders very securely.

SUMMARY OF THE INVENTION

The general object of this invention is to provide an improved mounting panel for hooks and holders. More particular objects are to provide a mounting panel that has a large weight capacity and that supports its hooks and holders very securely.

I have invented an improved modular mounting panel. The panel comprises: (a) a base; and (b) a plurality of raised members on the base arranged in a grid of straight rows and columns, each raised member having a plurality of inwardly sloping side walls to define a dovetail slot between each row and between each column.

The modular mounting panel of this invention accepts a variety of hooks and holders with dovetail projections. The mounting panel has a large weight capacity and it supports its hooks and holders very securely.

DETAILED DESCRIPTION OF THE INVENTION

Figure 1:
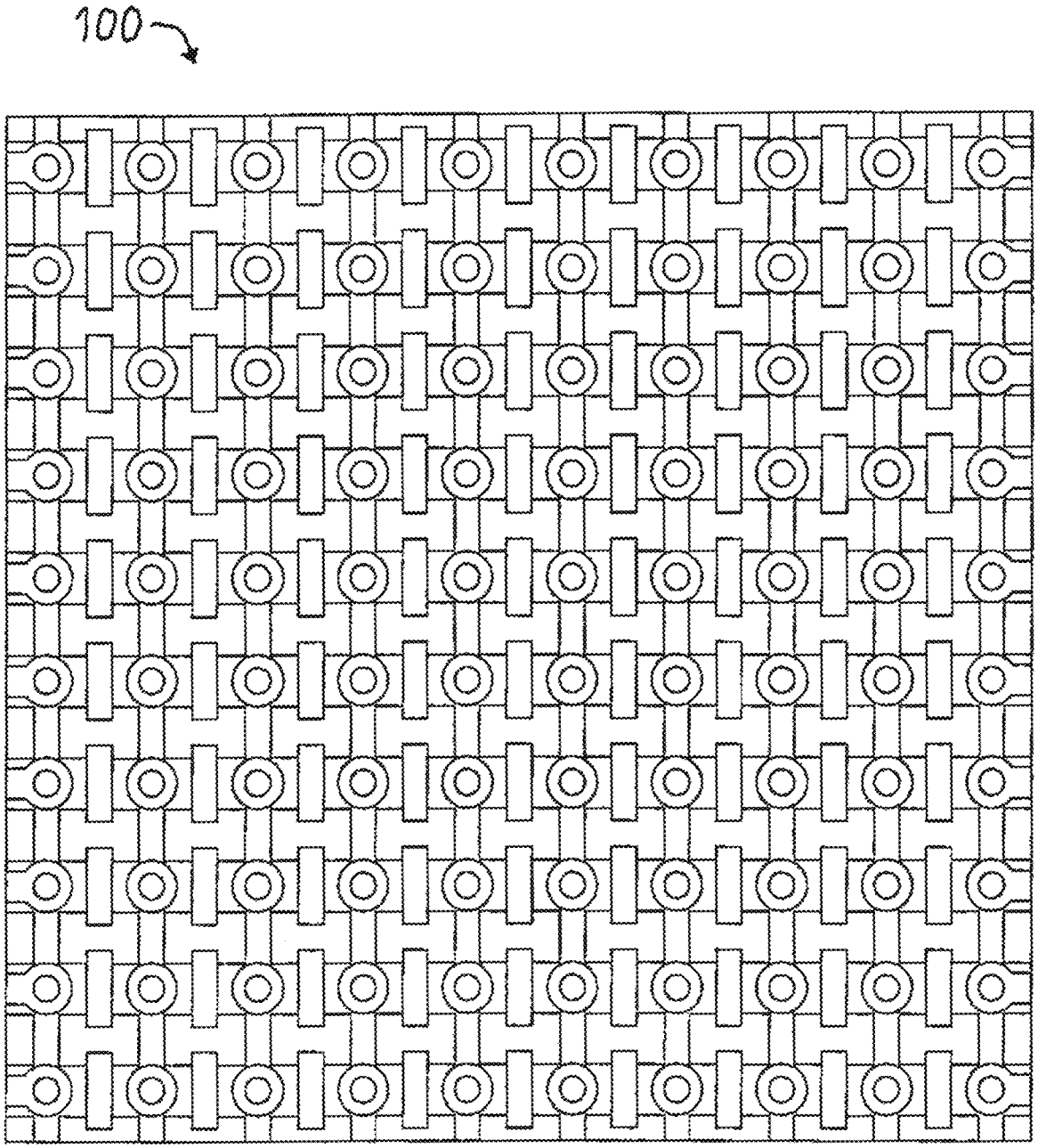
FIG. 1 is a front elevation view of a preferred embodiment of the mounting panel of this invention.
Figure 2:
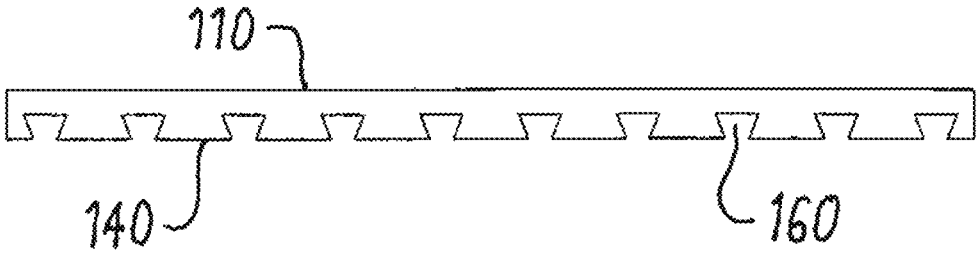
FIG. 2 is a is a top plan view thereof.
Figure 3:
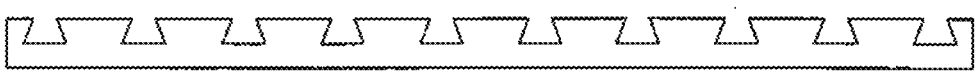
FIG. 3 is a bottom plan view thereof.
Figure 4:
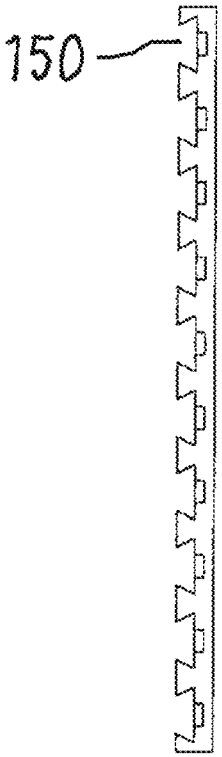
FIG. 4 is a right side elevation view thereof.
Figure 5:
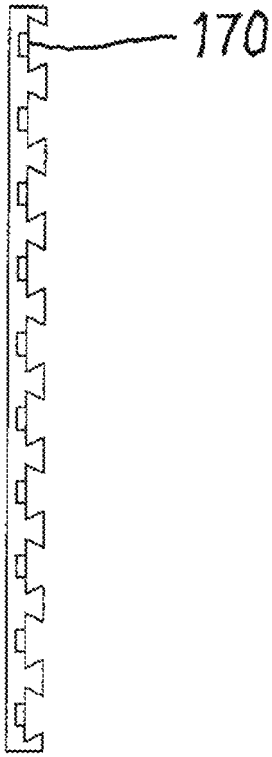
FIG. 5 is a left side elevation view thereof.

This invention is best understood by reference to the drawings. Referring to FIGS. 1 to 9, a preferred embodiment of the mounting panel 100 of this invention has a base with a plurality of raised members. The panel contains dovetail slots between each row and each column that accept a variety of hooks and holders having dovetail projections.

The mounting panel is generally rectangular in shape so the panels are easily abutted against other panels. The size and proportions of the mounting panel are matters of choice. The panel shown in the drawings is square, however rectangular panels are equally suitable. The panel is preferably made of a moldable thermoplastic.

The base 110 has a flat rear surface for mounting flush against a surface. The base has a plurality of openings for mounting the panel against a surface with screws or other fasteners. The preferred embodiment of the base contains both rectangular slots 120 and circular openings 130. If desired, octagrams (octagonal stars with eight points) are substituted for some or all of the circular openings.

Figure 12:
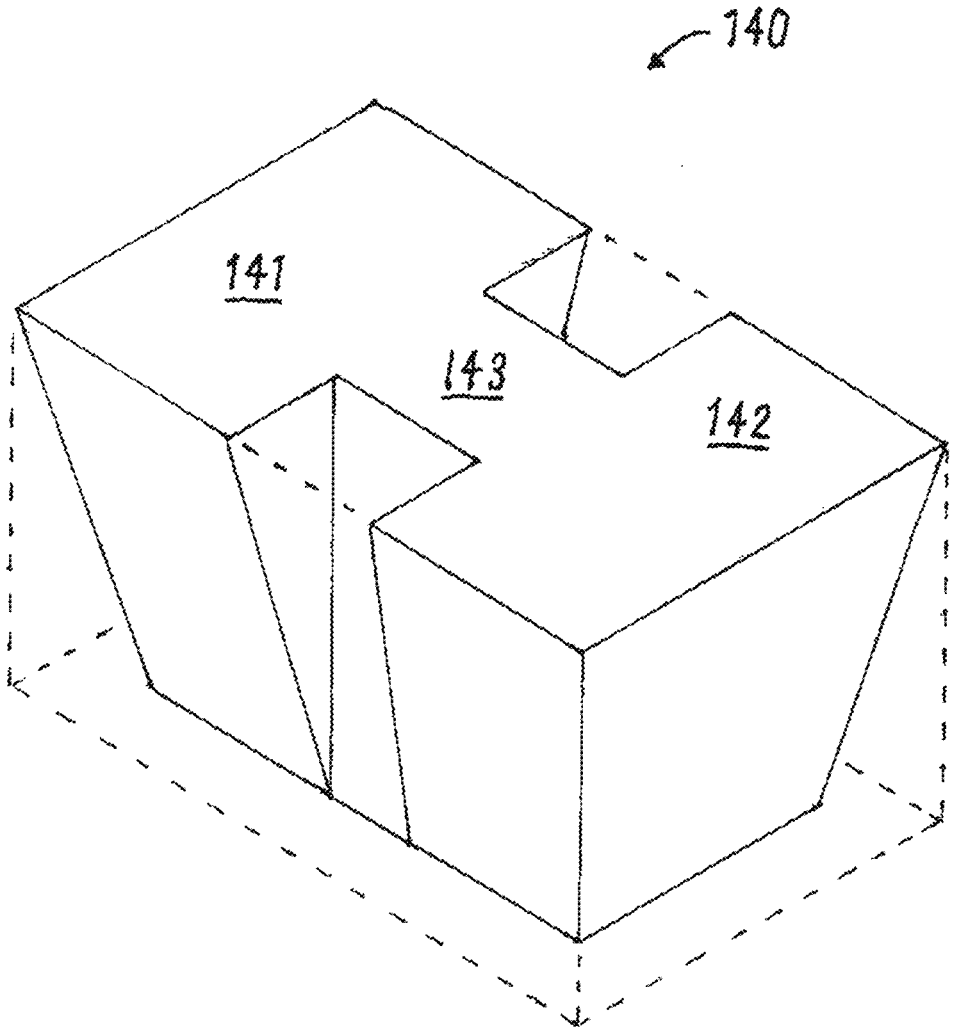
FIG. 12 is a detailed perspective view of a raised member.

The raised members 140 are arranged on the base in a grid of straight rows and columns. The raised members have inwardly sloping slide walls that define a horizontal dovetail slot 150 between each row and a vertical dovetail slot 160 between each column. The horizonal dovetail slots and the vertical dovetail slots are slightly different in width in the embodiment shown, but are of the same dimensions if desired. The raised members preferably have an upper surface parallel to the base. The shape of the raised members is a matter of choice. Square or rectangular upper surfaces are suitable, but the preferred shape is a block capital letter "I" as shown in detail in FIG. 12. This member has an upper rectangular crossbar 141, a lower rectangular crossbar 142, and a rectangular bar 143 connecting the crossbars. In FIG. 12, the dotted lines show the outline of a cuboid (also known as a rectangular prism) to emphasize the inwardly sloping side walls of the raised member.

Figure 6:
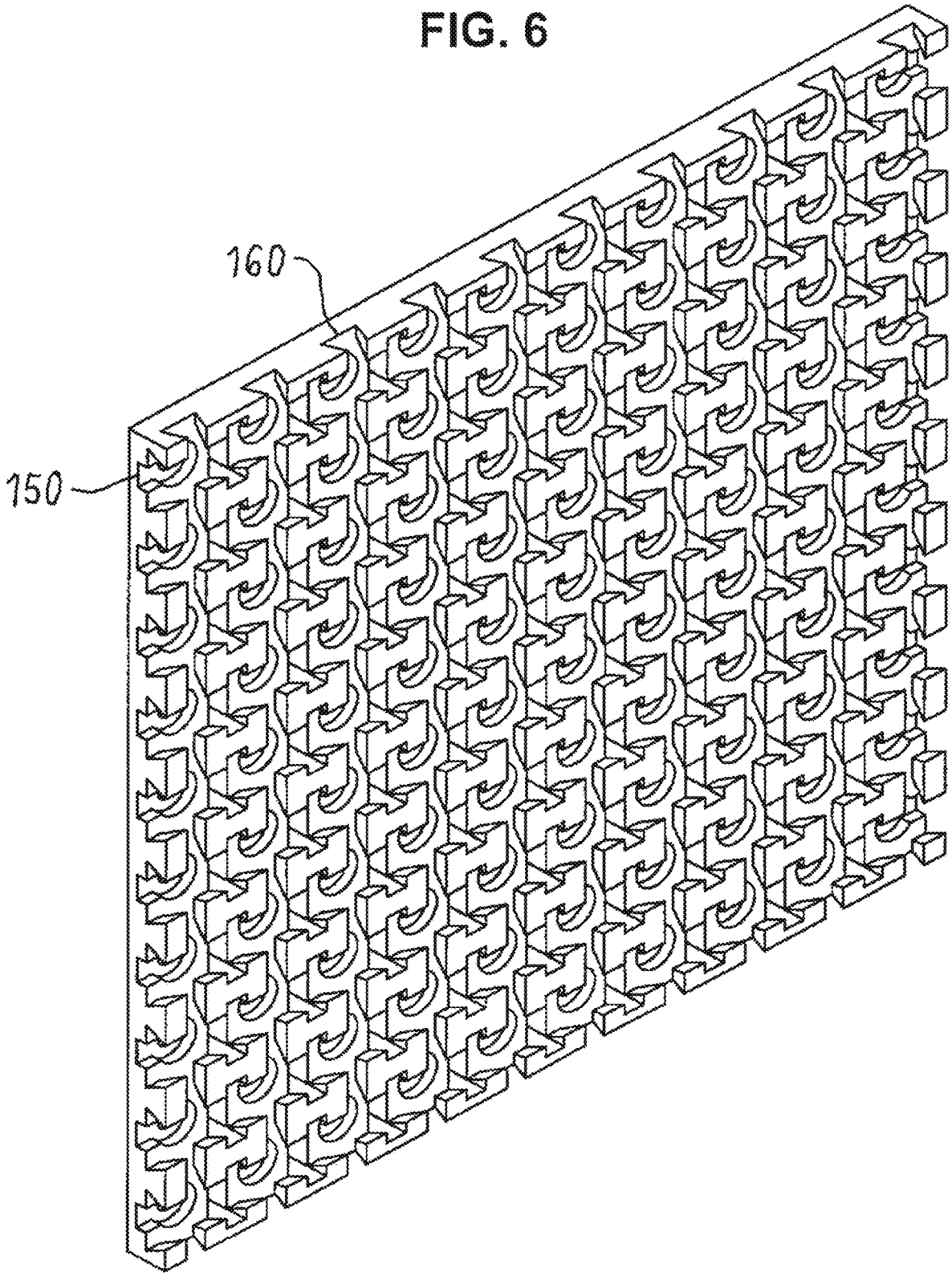
FIG. 6 is a front, top, and left side perspective view thereof.
Figure 7:
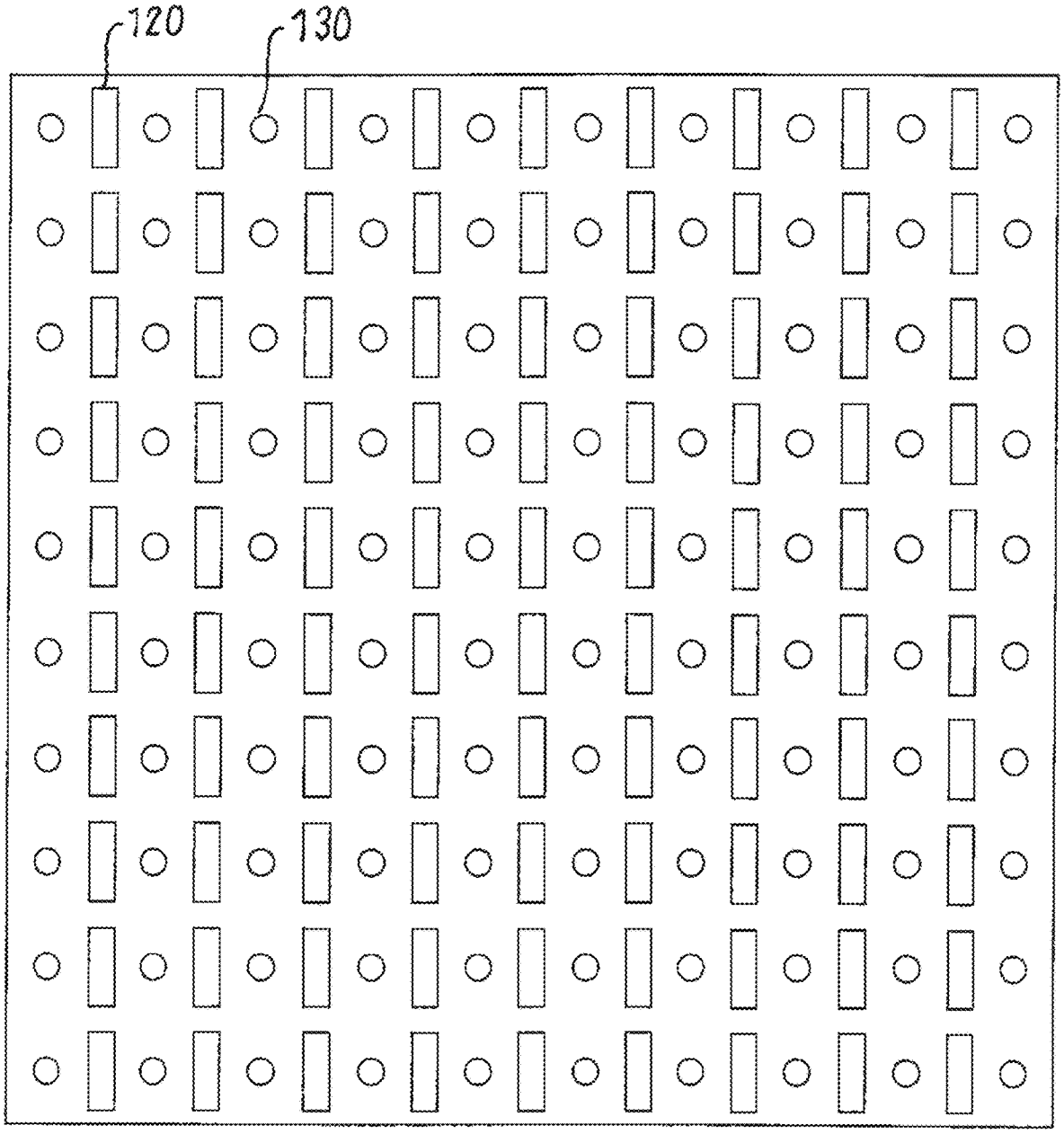
FIG. 7 is a rear elevation view thereof.
Figure 8:
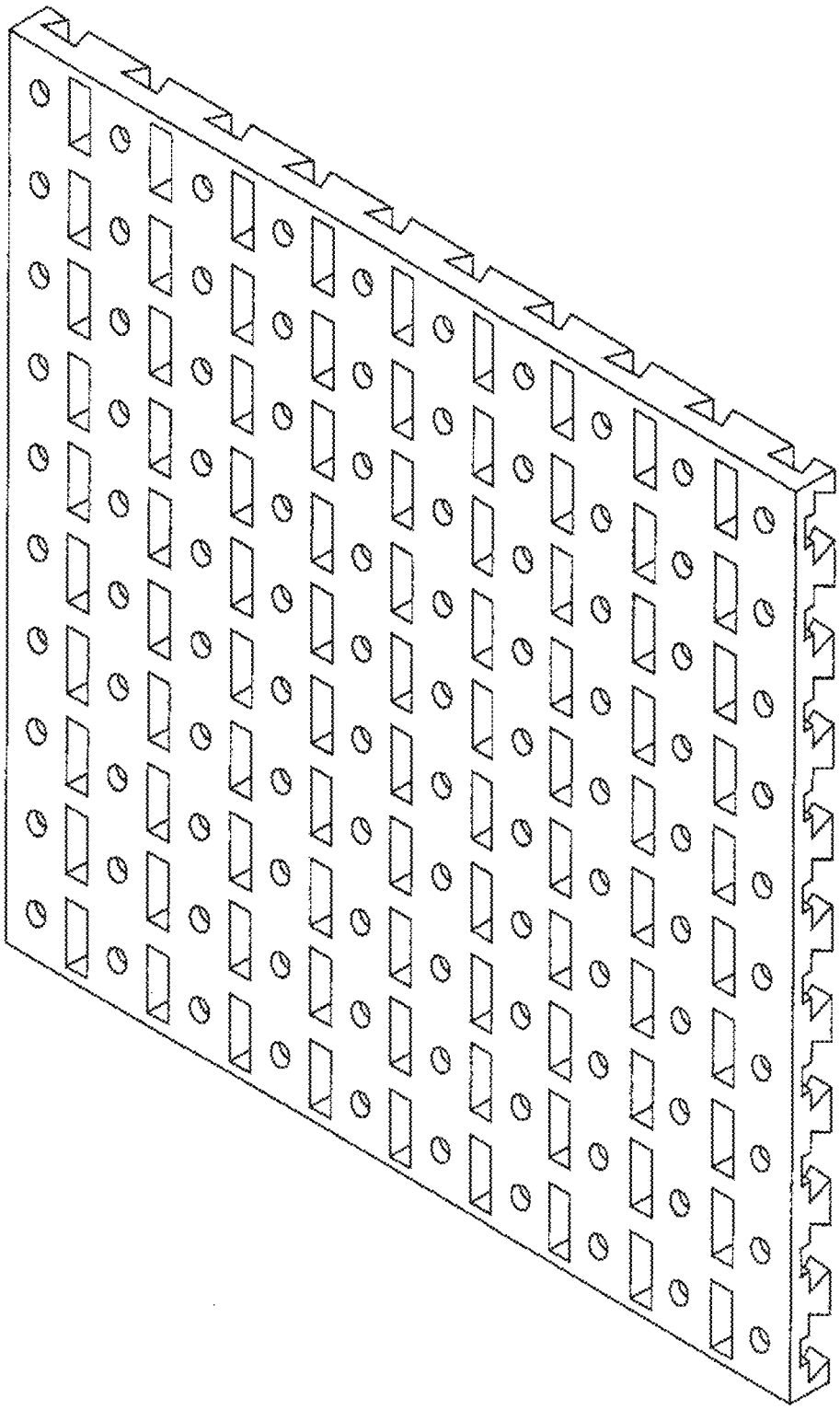
FIG. 8 is a rear, top, and left side perspective view thereof.

The preferred embodiment contains square channels 170 in the horizontal dovetail slots as best seen in FIGS. 6 and 8. The square channels provide recessed space for screw heads, zip ties, electrical cords, and the like so the dovetail slots are unimpeded.

Figure 9:
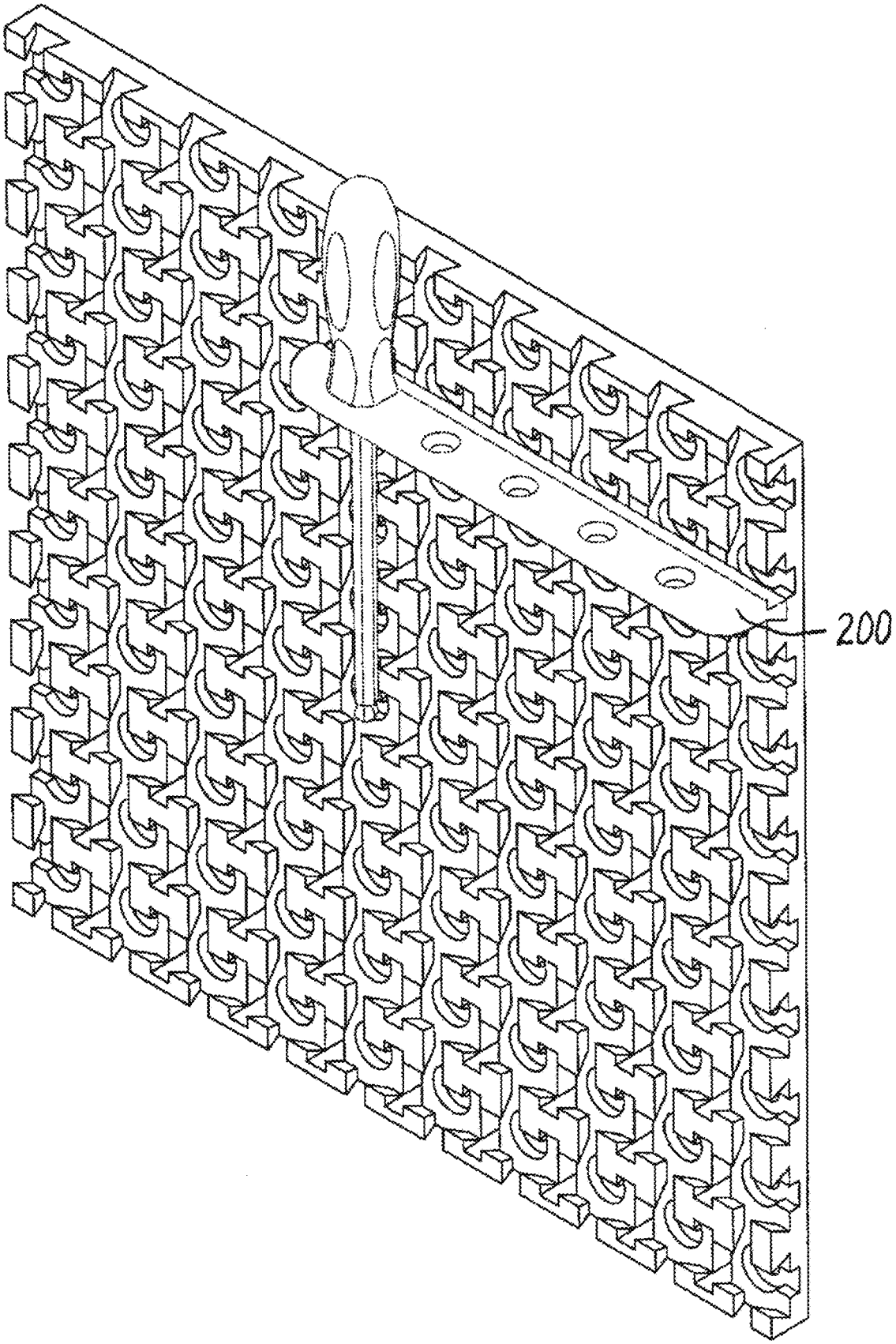
FIG. 9 is a front, top, and right perspective view thereof showing the mounting of a screwdriver holder containing one screwdriver.
Figure 10:
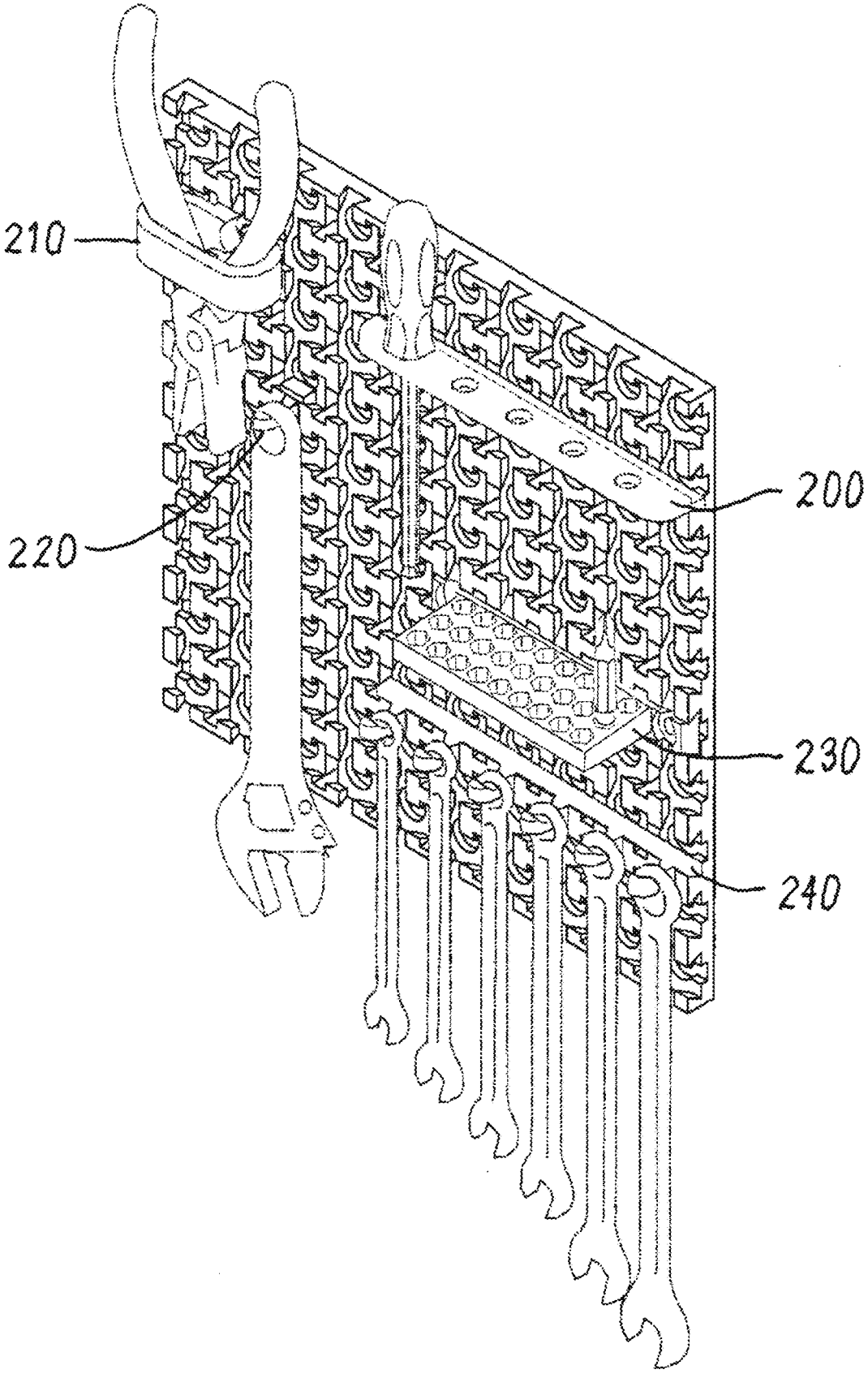
FIG. 10 is a front, top, and right perspective view thereof showing the mounting of a screwdriver holder containing one screwdriver, a pliers holder containing one pair of pliers, a single hook holding one adjustable wrench, a drill bit holder containing one drill bit, and a six hook holder holding six combination wrenches.
Figure 11:
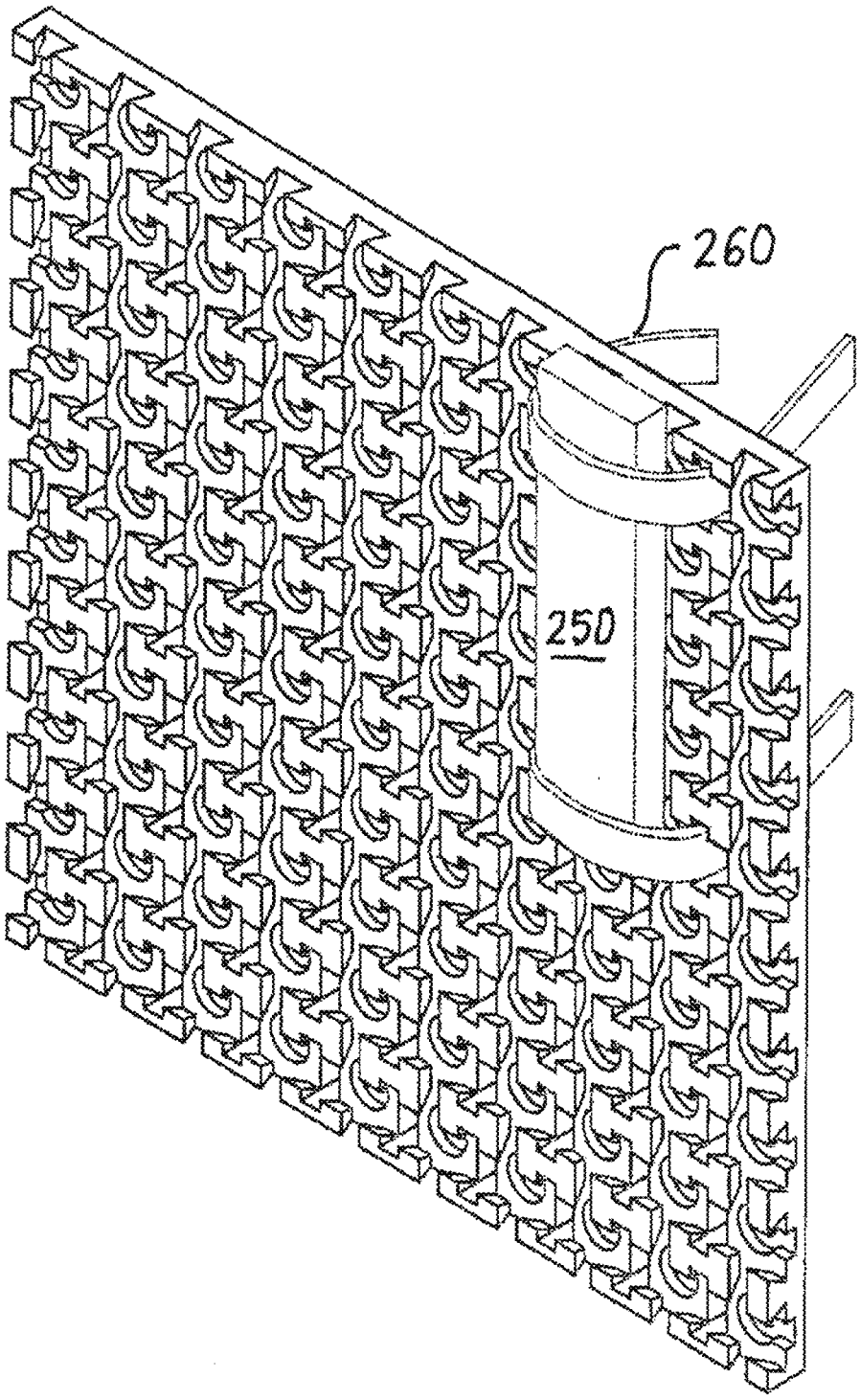
FIG. 11 is a front, top, and right perspective view showing the mounting of a sanding block with two straps.

A variety of hooks and holders with dovetail projections that mate with the dovetail slots are used with the mounting panel. A screwdriver holder 200 is shown in FIG. 9. A screwdriver holder 200, a pliers holder 210, a single hook 220, a drill bit holder 230, and a six hook holder 240 are shown in FIG. 10. A sanding block 250 attached with two straps 260 is shown in FIG. 11.

The mounting panel of this invention has many advantages over prior art products. It accepts a wide variety of hooks and holders and holds them securely due to the dovetail connection that distributes the weight over multiple raised members.

I claim:

1. A mounting panel comprising:

(a) a flat base having a plurality of openings for attaching the mounting panel to a vertical surface; and (b) a plurality of raised members on the base arranged in a grid of straight rows and columns, each raised member forming an upper surface parallel to the base, the upper surface having the shape of a block capital letter I with an upper rectangular crossbar, a lower rectangular crossbar, and a rectangular bar connecting the upper crossbar and the lower crossbar, each raised member having a plurality of inwardly sloping side walls to define a dovetail slot between each adjacent row and between each adjacent column.

2. The mounting panel of claim 1 wherein the openings in the base comprise rectangular slots and circular openings.

3. The mounting panel of claim 1 additionally comprising a hook or a holder having a dovetail projection fitting into a respective dovetail slot from the dovetail slots between two adjacent rows of raised members or between two adjacent columns of raised members.

* * * * *